United States Patent [19]

Watt

[11] 4,333,368

[45] Jun. 8, 1982

[54] METHOD AND APPARATUS FOR GENERATING ASPHERICAL SURFACES OF REVOLUTION

[75] Inventor: Gordon J. Watt, Fairfield, Conn.

[73] Assignee: Kollmorgen Technologies Corporation, Dallas, Tex.

[21] Appl. No.: 169,072

[22] Filed: Jul. 15, 1980

[51] Int. Cl.[3] ..... B23B 3/00; B23B 3/28

[52] U.S. Cl. ..... 82/1 C; 82/12; 82/18

[58] Field of Search ..... 82/1 C, 12, 18, 19

[56] References Cited

U.S. PATENT DOCUMENTS

| | | | |
|---|---|---|---|
| 3,696,695 | 10/1972 | Adams | 82/1 C |
| 3,881,378 | 5/1975 | Bettiol | 82/19 X |
| 4,083,272 | 4/1978 | Miller | 82/12 |
| 4,114,486 | 9/1978 | Hooker | 82/12 |
| 4,264,249 | 4/1981 | Dawson | 82/12 X |

*Primary Examiner*—Harrison L. Hinson

*Attorney, Agent, or Firm*—Ladas & Parry

[57] ABSTRACT

An aspherical surface generating method and apparatus which optimizes the path of a moving cutting tool tip to fit a given aspherical surface of revolution to be cut on a rotating work piece engaged by the moving tip. The apparatus is a modified spherical generator, the modifications and control of which adapt it to continuously match the curvature of the path of the moving cutting tool tip to that of the given aspherical surface of revolution by adjusting the dynamic machine center in the direction of the evolute of the curve, i.e. along the locus of the radius of curvature of the given surface at the tool tip.

10 Claims, 9 Drawing Figures

METHOD AND APPARATUS FOR GENERATING ASPHERICAL SURFACES OF REVOLUTION

BACKGROUND OF THE INVENTION

This invention relates to the generation of aspherical surfaces of revolution.

Aspherical surfaces of revolution are conventionally produced by numerically controlled machines or by correction of spherical surfaces through use of lapping and polishing techniques. For instance, it is customary to produce a spherical surface which approximates a desired aspherical surface, and then systematically to remove or add material until the desired asphericity is obtained. The initial spherical surface may be produced by the well-known chordal generator with which one cuts the spherical surface by rotating a workpiece about one axis against a tool tip being rotated about a second axis normal to and intersecting the first axis. The spherical radius is equal to the distance of the tool tip from its center of rotation.

SUMMARY OF THE INVENTION

The principal aim of the invention, both in its method and apparatus aspects, is to optimize the path of a moving cutting tool tip to fit a given aspherical surface of revolution to be cut on a rotating workpiece engaged by the moving tip.

According to the invention, this aim may be achieved with a modified chordal generator adapted to continuously match the curvature of the path of the moving cutting tool tip to that of the given aspherical surface of revolution by adjusting the machine center of the modified chordal generator in the direction of the evolute of the curve, i.e. along the radius of curvature of the given surface at the tool tip. A chordal generator, modified to have such machine center adjustment capability and associated with suitable controls to effect the continuous matching of curvatures, constitutes an aspherical generator in accordance with the apparatus aspect of the invention. Such an aspherical generator has at least four degrees of adjustment respectively about its x, y, z and trunnion tilt axes. More particularly, the generator is developed from a conventional spherical generator comprising a workhead spindle, tool holder spindle and a trunnion axis normal to the plane of the intersecting spindle axes, modified to provide for controlled motion and readout of speed and angle of the three axes, the addition of means for off-setting the spindle axes along the trunnion axis, means for axially displacing the workhead spindle, and means for adjusting the tool tip relative to the face of the tool holder spindle.

BRIEF DESCRIPTION OF THE DRAWINGS

In order that the invention, both in its method and apparatus aspects, may be more fully understood, it will now be described with reference to the accompanying drawings in which.

DETAILED DESCRIPTION OF THE INVENTION

Figure 3:
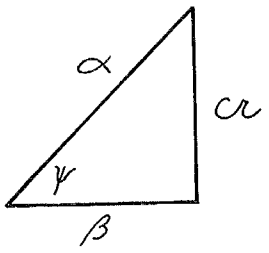
FIGS. 3 and 4 are representations of the trigonometric relationships of parameters involved in a practical aspherical generator according to the invention.

Before describing the invention in detail, an explanation of the mathematical considerations it takes into account will be given by way of introduction.

Since a sphere has constant radius of curvature, it may be assumed that an asphere has variable radii of curvature. When dealing with surfaces of revolution, one may be concerned only with a plane curve formed by the surface and an intersecting plane containing the axis of revolution. The locus of the centers of curvature, or evolute of the curve, may be used to describe the curve, so long as the radii of curvature are known.

Any other curve lying in the surface of revolution may also be used to describe the surface, so long as it is continuous from the inner to outer bounds. Such a curve may be found by the intersection of an oblique plane with the surface, or by common tangency with another surface not symmetric with the axis of revolution.

The concept of intersection with an oblique plane already exists in the chordal generator. In the case of a sphere, the curve of intersection is a circle smaller than or equal to a great circle. One condition is that a line normal to the intersecting plane passing through the center of the circle of intersection must itself intersect the axis of revolution. The distance from any point on the circle of intersection to the point of intersection of the two axes is equal to the spherical radius.

The case where the axes do not intersect will now be addressed. Starting with the chordal generator, two possibilities exist. The axis of the circle of intersection may be shifted in a direction normal to the plane of the two axes; or may be rotated around a line normal to the plane of the two axes not passing through the common point.

In the simple case of pure translation, this modified chordal generator now produces a toroidal surface when used in the manner of a chordal generator. The toroid may be oblate or elongated, depending on the direction of translation. We will identify oblateness with positive translation for purposes of discussion. We consider that a best fitting toroid may better resemble an aspherical surface of revolution than a best fitting sphere. For example, one may mistake a moderately oblate toroid for an oblate ellipse of revolution, especially if the sections around the poles are neglected.

Applying this principle to practical optical elements such as a pair of ellipses of revolution, one finds that useful optical segments may be generated within a few microns on surfaces between fifty and one hundred millimeters diameter having a center hole. In the case of one primary, the discrepancy is plus or minus one micron for eccentricity of nine tenths (0.9), and within plus or minus four microns for the secondary with eccentricity of four tenths (0.4).

The significance of this is that corrections of only a few microns need to be applied to the naturally generated surface. In terms of resolution, this means that one percent correction corresponds to a resolution of one thousandths of a percent (0.001%) on an x-y coordinate machine, such as an N.C. lathe or milling machine. Also significant is that a best fitting sphere falls far short of approximating the ellipse of revolution.

Figure 1:
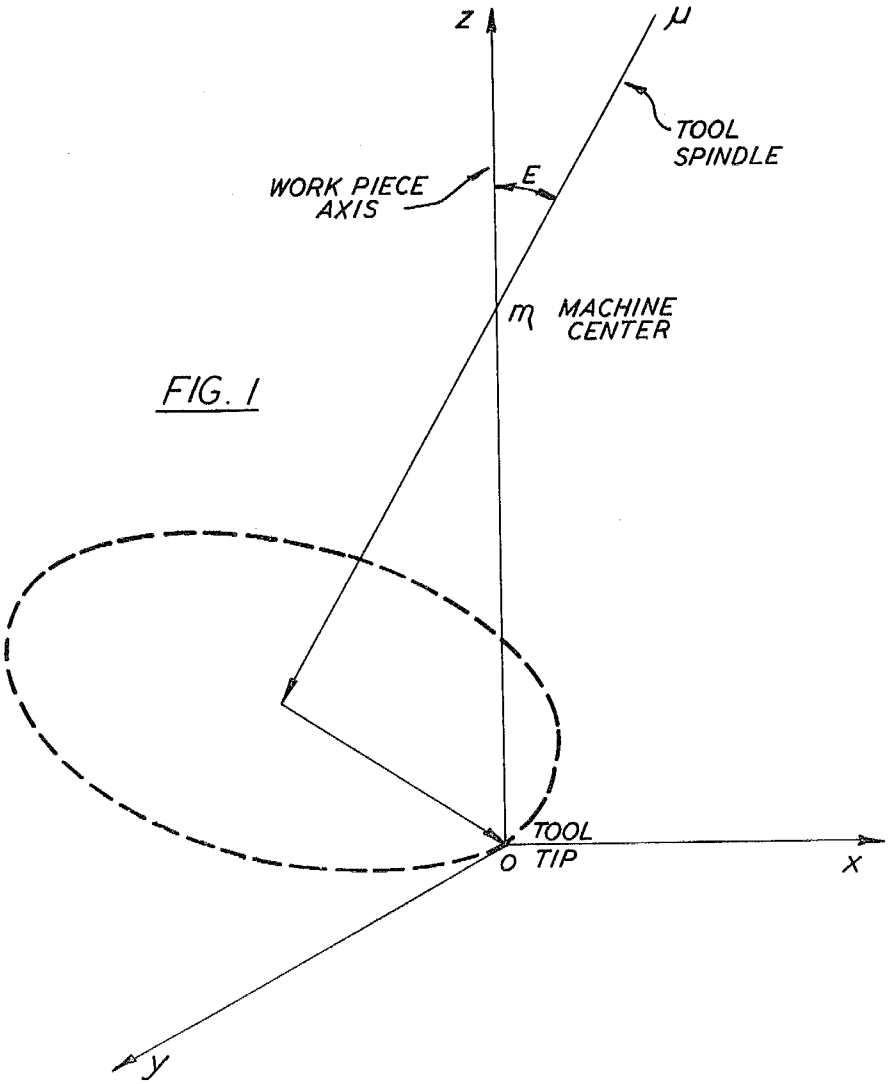
FIG. 1 depicts the coordinate axes and tool tip axis defining a chordal generator when used simply to produce spherical surfaces of revolution on a workpiece.

The geometrical basis for a chordal generator as defined by the coordinates axes in FIG. 1 will now be described. The workpiece axis is taken to be the z-axis. The tool spindle axis $\mu$ is taken to lie in the yz plane. The $\mu$ and z axes are inclined at some angle E relative to one another around the $\mu$ axis. Consider that the tool tip passes through the origin of the reference coordinate axes. As the tool is turned about the $\mu$ axis, it will describe a circle with radius equal to its perpendicular distance from the tool spindle axis. This circle must lie in a sphere which contains the origin o with center at the intersection m of the $\mu$ and z axes.

One may convince himself of these facts by laying a ring on a ping-pong ball and noting that the axis of the ring must pass through the center of the ball. If a ring has unity radius under the conditions of FIG. 1, then the spherical radius must be equal to cosecant E, because $1=\overline{om}$ sine E, where $\overline{om}$ is the distance from o to m.

Operation of the disclosed machine depends on fundamental geometry based on machine coordinates and the geometry of surfaces of revolution. There are two spindle axes. One carries the work piece and the other carries a tool. Allowing that the tool has a basic reference point, such as a tip or center, which does not lie on the tool spindle axis, one can see that the tool describes a circle in space as the work spindle is turned. It is equally clear that any such circle so described lies at some fixed distance from any arbitrary point on the tool spindle axis.

Considering then the workpiece, whose surface of revolution is formed by relative motion of the tool tip and the work surface, one must conclude that any point in the workpiece traces a circle in space as the work spindle is turned. Any point on said circle is equidistant from any arbitrary point on the work spindle axis. Now if the two spindle axes intersect, it is clear that the surface of revolution formed by the circular path of the tool through the work piece as the work piece turns must be on a sphere with center at the point of intersection of the two axes. Distance from the tool tip to said point of intersection must determine the spherical surface as generated.

In the following text, a unity radius tool tip circle will be used without losing generality, because dimensions of linear measurements are arbitrary subject to future definition. The center m is defined as the machine center, lying in the $\mu$ axis, directly above the tool tip when the tip is in its lowest position.

In a practical machine, the work piece axis and the tool spindle axis may fail to intersect. Also, the tool tip may fail to pass through the origin of the coordinate system, although we adjust the bottom of the surface of revolution to be at the origin.

In these cases, the machine center m is displaced from the z axis, in amounts $\delta x$ and $\delta y$, respectively. The tool tip may lie above or below the xy plane when in its lowest position. This displacement is $\delta z$. With displacements of $\delta y$ and/or $\delta z$, the machine still produces a spherical surface in the work piece. A $\delta x$ displacement, however, results in a toroidal surface being cut.

Figure 2:
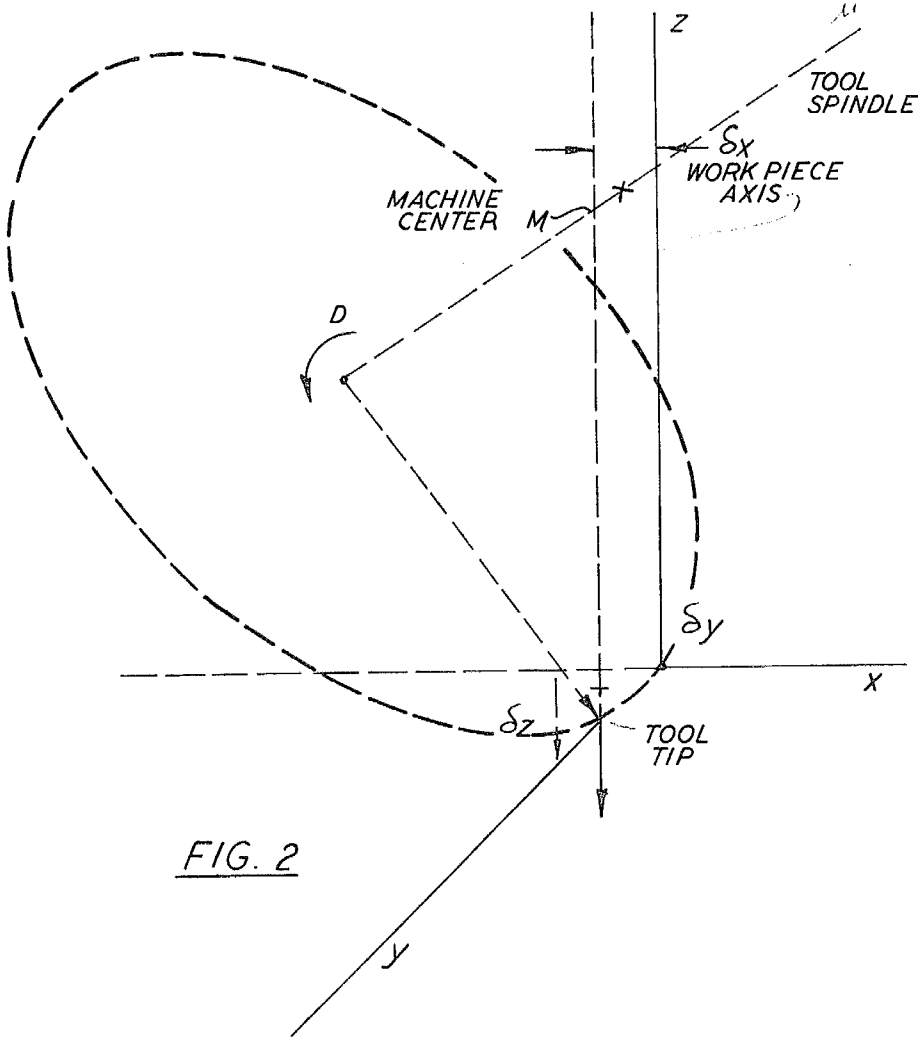
FIG. 2 is similar to FIG. 1 and additionally depicts small displacements of the machine center of the chordal generator from the z-axis in the respective directions of the x-axis and y-axis, with a small displacement of the tool tip in the direction of the z-axis, whereby the chordal generator defined in FIG. 1 is modified to be an aspherical generator for producing aspherical surfaces of revolution.

The coordinate system is taken to originate at the apex of the surface of revolution as indicated in FIG. 2. The surface may be concave or convex, depending on the sign of z in the equation $z=f(r)$ which defines the surface of revolution. In this equation $r=\sqrt{x^2+y^2}$, the inherent statement of a surface of revolution, or symmetry about the z axis.

In FIG. 2, the machine coordinates are shown as dotted straight lines. The machine center is shown displaced forward and to the left. The $\mu$ axis penetration of the zx plane is indicated by the small cross behind m. The tool tip is seen to lie below the xy plane. The line between the tool tip p and machine center parallel to the z axis penetrates the xy plane at the small cross forward and to the left of the origin 0. As depicted in FIG. 2, $\delta y$ is positive, $\delta x$ is negative and $\delta z$ is negative.

As the tool spindle is turned about axis $\mu$, through an angle D, the tool tip path P will be traced out. Intersection of path P with the rotating work piece which turns about the z axis, results in the surface of revolution.

It is to be noted that discontinuities exist around the vertex when the machine center is displaced. Most aspherical surfaces used in optical systems allow these anomolies, since the area around the vertex is not used or is negligible.

There now follows a description of the method according to the invention for determining machine settings to optimize the tool tip path P to fit a desired surface of revolution and for controlling the machine center to compensate for any misfit. It is to be recognized that the machine center must follow the evolute, i.e. locus of the center of curvature of the desired surface at the tool tip, in order for a perfect surface to be generated.

The mathematics dealing with curves is well developed, and may be used to appreciate the physical situation for the practical aspherical generator disclosed herein.

Basically one begins with the tool tip path P shown in FIG. 2. The tool spindle angle D is zero when as depicted in the drawing. Taking a set of coordinates x, y, z, originating at $p_0$ and parallel to the x, y, z set originating at 0, the apex of the asphere, we may write the tool tip position as:

$$\bar{x}=1 \sin D$$
$$\bar{y}=1 \cos E\,(1-\cos D)$$
$$\bar{z}=1 \sin E\,(1-\cos D),$$

remembering that a normalized machine with tool arm equal to unity is involved. Transposing to the workpiece coordinates (typically $x_p=\bar{x}+\delta x$, $y_p=\bar{y}+\delta y$, $z_p=\bar{z}+\delta z$), the locus of the tool tip may be written as:

$$x_p=\sin D+\delta x$$
$$y_p=\cos E(1-\cos D)+\delta y$$
$$z_p=\sin E\,(1-\cos D)+\delta z,$$

and the location of the machine center m with reference to $p_0$, i.e. $D=0$, may be written as:

$$x_m=\delta x$$
$$y_m=\delta y$$
$$z_m=\delta z+1 \csc E$$

Therefore, distance $p_0$ from the tool tip to the machine center for any angle D is given by:

$$\begin{aligned} p_o^2 &= (x_p - x_m)^2 + (y_p - y_m)^2 + (z_p - z_m)^2 \\ &= \sin^2 D + \cos^2 E(1 - \cos D)^2 + (\sin E(1 - \cos D) - csc\ E)^2 \\ &= \sin^2 D + \cos^2 E(1 - \cos D)^2 + \sin^2 E(1 - \cos D)^2 - 2(1 - \cos D) + csc^2 E \\ &= \sin^2 D + (1 - \cos D)^2 - 2(1 - \cos D) + csc^2 E \\ &= \sin^2 D + \cos^2 D + 1 - 2\cos D - 2(1 - \cos D) + csc^2 E \\ &= 2(1 - \cos D) - 2(1 - \cos D) + csc^2 E \\ &= csc^2 E \end{aligned}$$

and so it is seen that any point cut by the tool tip ($x_p$, $y_p$, $z_p$) on the surface of revolution is at a distance $$p_o = csc\ E$$

from the machine center, a constant distance regardless of tool angle D.

Now it is recognized that the tool tip path is a space curve in the work piece coordinate set x, y, z. One may, however, convert the analytical problem to a plane by considering the projection of point p on the xy plane:

$x_p = \sin D + \delta x$ $y_p = \cos E\ (1 - \cos D) + \delta y$, and $r^2 = (\sin D + \delta x)^2 + (\cos E(1 - \cos D) + \delta y)^2$, and then consider the intersection of a plane containing the z axis with the desired surface of revolution. The plane containing the tool tip as well will be called the r plane, and the profile of the surface there can be expressed as a plane curve, viz., $z = f(r)$. A general aspheric surface is often written as:

$$z = \frac{cr^2}{1 + \sqrt{1 - (1 - e^2)c^2r^2}} + br^4 + dr^6 + \ldots,$$

the first term being the general expression for a conic, with vertex curvature c and eccentricity e. This expression may be rewritten in dimensionless form as:

$$cz = \frac{(cr)^2}{1 + \sqrt{1 - (1 - e^2)(cr)^2}} + \frac{b(cr)^4}{c^3} + \frac{d(cr)^6}{c^5} + \ldots,$$

noting that $b/c^3$, $d/c^3$, $d/c^5$, etc. are dimensionless.

Of special interest are expressions for slope and radius of curvature, for the conic sections ($b = d = \ldots 0$)

$$\text{slope, } \frac{dz}{dr} = \sqrt{\frac{(cr)^2}{1 - (1 - e^2)(cr)^2}}$$

radius curvature, $cR = (1 + e^2(cr)^2)^{3/2}$. Also the second derivative is useful in determining the radius of curvature when the aspheric coefficients are involved.

$$\text{Rate of change of slope } \frac{d^2z}{dr^2} = \frac{c}{\sqrt{(1 - (1 - e^2)(cr)^2)^3}}$$

Define the slope angle as $\psi$. For the conic section, define $\beta = \sqrt{1 - (1 - e^2)(cr)^2}$. Then the $\tan\psi = (cr)/\beta$, and in the triangle (FIG. 3), the hypotenuse $$\alpha = \sqrt{\beta^2 + (cr)^2} = \sqrt{1 + e^2(cr)^2}$$

Figure 4:
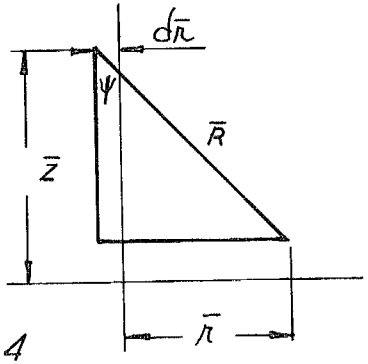

Using these auxiliary variables, $$cz = \frac{(cr)^2}{1 + \beta},\ \frac{dz}{dr} = \frac{cr}{\beta} = \tan\psi,$$

$$CR = \alpha^3,\ \frac{d^2z}{dr^2} = \frac{c}{\beta^3}$$

and points on the evolute (FIG. 4), $$\bar{r} = r - R\sin\psi = r - \frac{\alpha^3}{c} \cdot \frac{cr}{\alpha} = r(1 - \alpha^2)$$

$$\bar{z} = z + R\cos\psi = \frac{cr^2}{1 + \beta} + \frac{\alpha^3}{c} \cdot \frac{\beta}{\alpha} = \frac{cr^2}{1 + \beta} + \frac{\alpha^2\beta}{c}$$

$$c\bar{r} = -cr(\alpha^2 - 1);\ c\bar{z} = \frac{(cr)^2}{1 + \beta} + \alpha^2\beta$$

As a specific example, consider matching a desired parabola for best fit to the normalized machine. For a parabola, eccentricity is unity.

Choose a machine setting of $E = 30°$ and $15° \leqq D \leqq 30°$. At the outer periphery ($D = 30°$), $r_p^2 \approx 0.25 + 0.0135 = 0.2635$, neglecting for the moment $\delta x$ and $\delta y$. Noting that the machine will cut a radius $= \csc E = 2.0$. Matching this to the radius of curvature of the part at $D = 30°$:

$$2c = (1 + .2635c^2)^{3/2}, \text{ squaring,}$$

$$4c^2 = 1 + .7904c^2 + .2083(c^2)^2 + .01829(c^2)^3, \text{ rewriting}$$

$$0 = 1 - 3.2096(c^2) + .2083(c^2)^2 + .01829(c^2)^3$$

which has a solution near $c^2 = 1/3.2096 = 0.312$ approximately at 0.318, from which $c = 0.564$ is computed. Therefore, one may judge that the parabola, $$z = 0.564r^2/2$$

will fit the machine set at $E = 30°$. Three questions persist, viz.,

1. Is this a best fit between $15° \leqq D \leqq 30°$?
2. Does the machine center lie on the z axis?
3. What is the effect of introducing aspheric coefficients?

To answer question 1, one may repeat the calculation for 15°, and compare the derived apex curvature.

Question 2 involves deriving the slope and finding the center of curvature as follows.

$$r_p^2 = .2635 \qquad r_p = .5133 \qquad cr_p = .2895$$

$$cz = \frac{.2895}{2} \qquad z = .0743 \qquad \frac{dz}{dr} = .2895$$

$$\sin(\tan^{-1} .2895) = .2782 \qquad .2782\ csc\ E = .5564$$

Therefore, $$\delta x = -.0431$$

-continued $$\cos(\tan^{-1}.2895) = .9606 \qquad .9606 \csc E = 1.9212$$

Therefore $z_m$ is $$1.9212 + .0743 = 1.9955 \text{ or}$$

$$\delta z = -.0045$$

For the moment, it is assumed that $\delta y=0$. With regard to question 3, one can see by inspection that positive aspheric coefficients will increase the slope and curvature compared to the basic conic.

It is to be noted that the aspheric coeefficients to be used in any calculation which is scaled to the machine must be changed according to the vertex curvature, i.e. $b/c^3$, $d/c^5$, etc.

Figure 5:
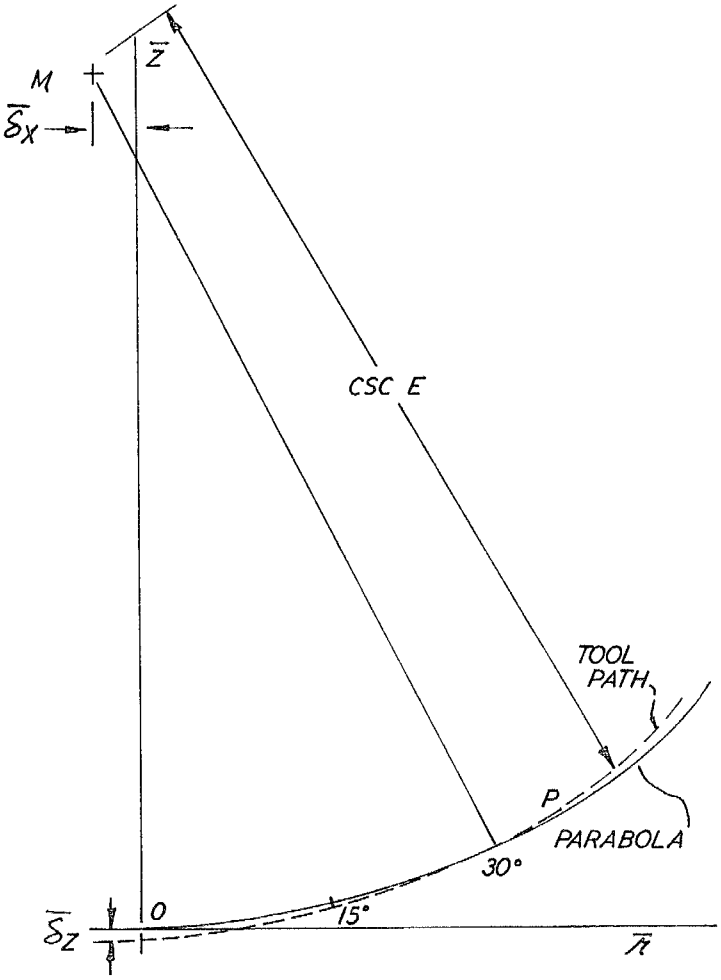
FIG. 5 is a graphical representation of the matching of a desired parabola for best fit to a normalized chordal generator.

The example just discussed is depicted in FIG. 5, as projected in the r plane. The machine fits the desired curve closely in the vicinity of p at D=30°. It must be remembered, however, that this is a three-dimensional problem and that the r plane projection is only a first order solution. Were the problem to be solved at D=15°, another solution would result and the r plane would be at another angle around the z axis. The locus of m for multiple solutions becomes the evolute of the space curve which is the intersection between the tool tip and the work surface.

Figure 6:
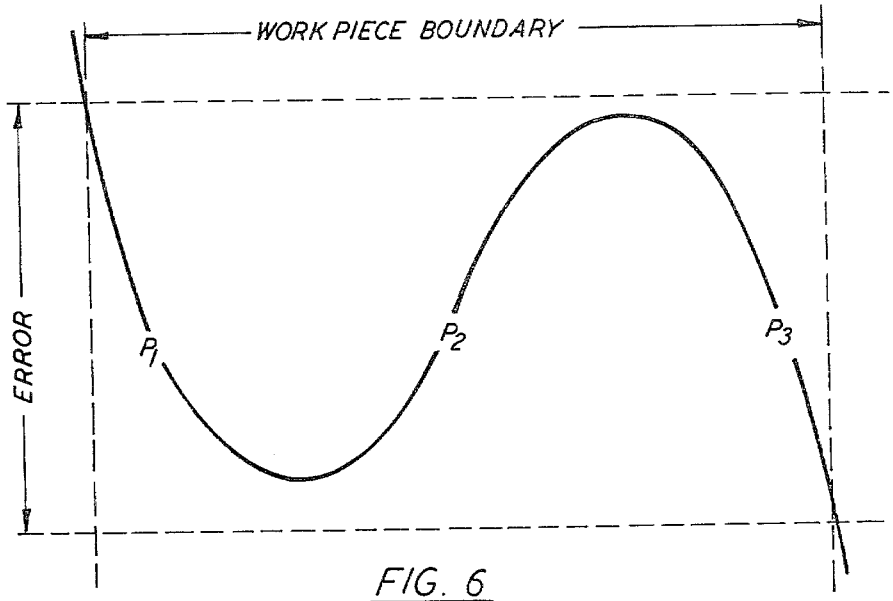
FIG. 6 depicts a typical error curve projected on the plane containing the tool tip of the normalized chordal generator.

Following the foregoing procedure and logic, one seeks a best average machine center and best scale for the analytic surface. Given the variables $\delta x$, $\delta z$, and c, it is possible to obtain an intersection between the tool tip and the desired work piece surface at three separate points. These points may be selected to minimize the error between the surface produced by a fixed tool center and the desired analytic surface. A typical error curve as projected in the r plane is shown in FIG. 6.

For the type of machine configuration and the surfaces being considered, an iterative solution is indicated as follows.

Step 1: Go through the procedures already described for some central point on the surface, or for two points near the edges. On this basis, locate an initial machine center and vertex curvature.

Step 2: With the constants so obtained, solve for the machine center which will put $p_1$ on the analytical surface. Begin with $\delta x$ far enough in the negative direction to assure that the tool tip falls above the surface near $p_3$. Solve for the distance above the surface at $p_3$.

Step 3: Using the distance obtained in Step 2, i.e. $\Sigma z_3$, and some fraction of the inverse slope at $p_3$ (say 70%), correct $\delta x$ in the positive direction by $$\delta x_{corr} = \frac{.7\Sigma z_3}{\delta z/dr\,|p_3}$$

Step 4: Re-compute $\Sigma z_1$ near $P_1$ using the corrected machine center, and put $P_1$ back on the analytic surface by adjusting $\delta z$ in the amount $(-\Sigma z_1)$.

Step 5: Continue to adjust $P_1$ and $P_3$ as described in Steps 2, 3, 4 until $p_1$ and $p_3$ lie on the analytic curve.

Step 6: Now check $P_2$ to see if the tool tip lies above or below the analytic curve. If it lies above, curvature of the analytic curve is too great. Adjust the curvature c downward by a computed increment proportional to $\Sigma z_2$, and then repeat Steps 2 through 5. Continue this process until $\Sigma z_1$, $\Sigma z_2$, $\Sigma z_3$ fall within desired limits.

If the residual error, as shown in FIG. 6, exceeds the allowable error for the surface figure, further correction must be made during the machining process. Ordinarily, one would think that the tool should be moved relative to the work surface in the direction of the z axis. This is, however, a very sensitive "one-for-one" correction and does not directly correct for the slope error which is occuring between the work piece and tool tip path.

A novel method of correction, which is an important feature of the invention and inherent in the machine structure disclosed, involves moving the machine center in the manner of Step 3 described above.

Effectively this process continuously matches the curvature of the tool path to that of the analytic surface by adjusting the machine center in the direction of the evolute of the curve.

Figure 7:
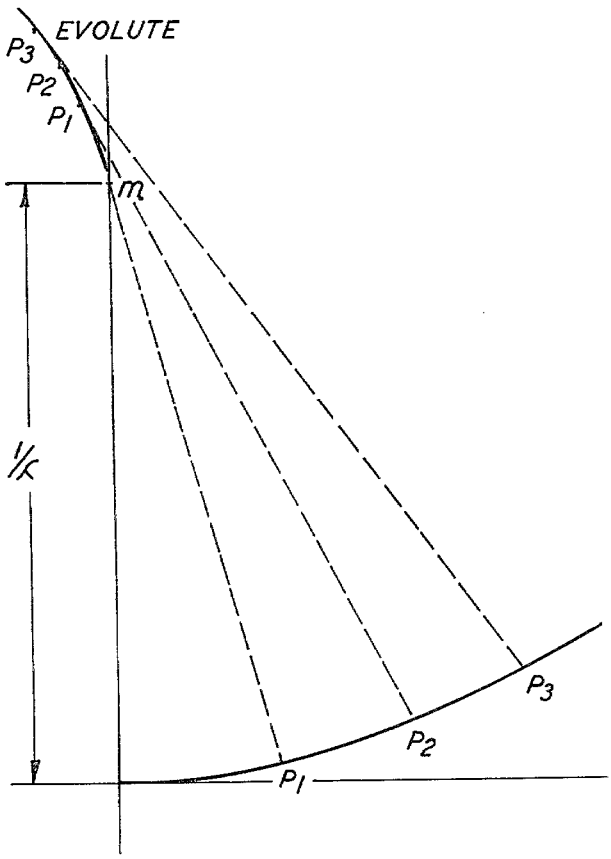
FIG. 7 illustrates the correspondence existing between points on a curve and points on the evolute of the curve.

Referring to FIG. 7, by mathematical definition, there is correspondence between points $p_i$ on the curve and points $p_i'$ on the evolute. An arc swung from the evolute point with radius of curvature at the corresponding curve point, matches the curve for distance, slope and curvature. One might consider a perfect machine which would continuously shift center along the evolute and at the same time vary the tool radius according to the curvature at the point of osculation on the surface.

Figure 8:
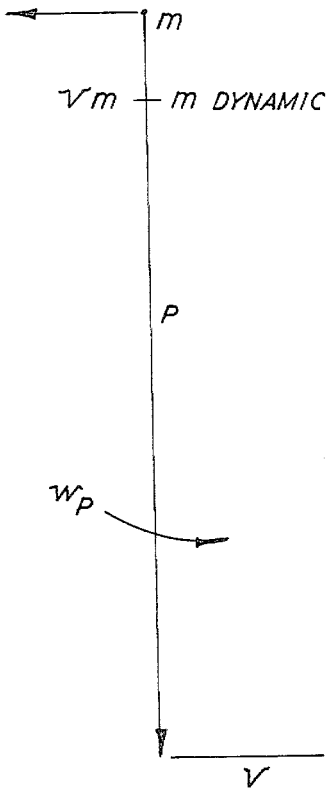
FIG. 8 is a diagram facilitating an understanding of the dynamic center concept used by the present invention.

To understand the machine embodiment, one must appreciate the notion of dynamic centers. Consider FIG. 8. The tool tip has a velocity v which is the sum of $\omega p$ and a linear velocity of the machine center relative to the x axis in the direction of $\delta x$. The angular velocity $\omega p$ is the rate at which the tool tip is turning about the machine center. Because of the combined velocities at either end, the tool tip is turning about a dynamic center which can be made to track the evolute centers without imparting significant motion of the actual machine center in the direction of $\delta z$. This action is not subject to positional errors in the direction of $\delta z$ whose main component is normal to the curve surface. The resulting surface level and surface slope are therefore bound to be more smooth and consistent, being the result of integrated machine motions with hardly any component in the normal direction.

With the foregoing analysis in mind, consider now the method for machine operation, as follows:

1. Convert the analytical surface to a dimensionless form which can be scaled to match a normalized generator with unity tool arc. This may preferably contain a conic expression for the first term after the manner described by Walter Augustyn at SPIE Los Angeles in February 1980.

2. Choosing one or more points along a planned tool path, derive a scale for the surface curve which will place its best average center of curvature near the machine center for the desired machine angle E. This trunnion angle depends on fixtures which hold the workpiece in position to be cut. Axis of the tool rotation spindle must intersect the work spindle axis near the center of curvature of the work piece in the first approximation.

3. Enter the curve parameters (e, c, b, d) into a computer program designed to iterate $\delta x$, $\delta z$, and c for best three point fit. This quickly converges to a set of machine settings which will naturally generate a toroidal surface as the tool is passed over the work piece. Values of $\delta x$ which will bring the tool tip to the desired analytic surface are then computed for intermediate points as a function of the tool spindle angle D.

4. By methods common to numerical control contouring, the machine center is moved dynamically along the x axis and D is turned at a constant rate, passing the tool over the workpiece. The tool is fed toward the work at the beginning of the cut by tilting the tool spindle axis by a small increment of E.

Figure 9:
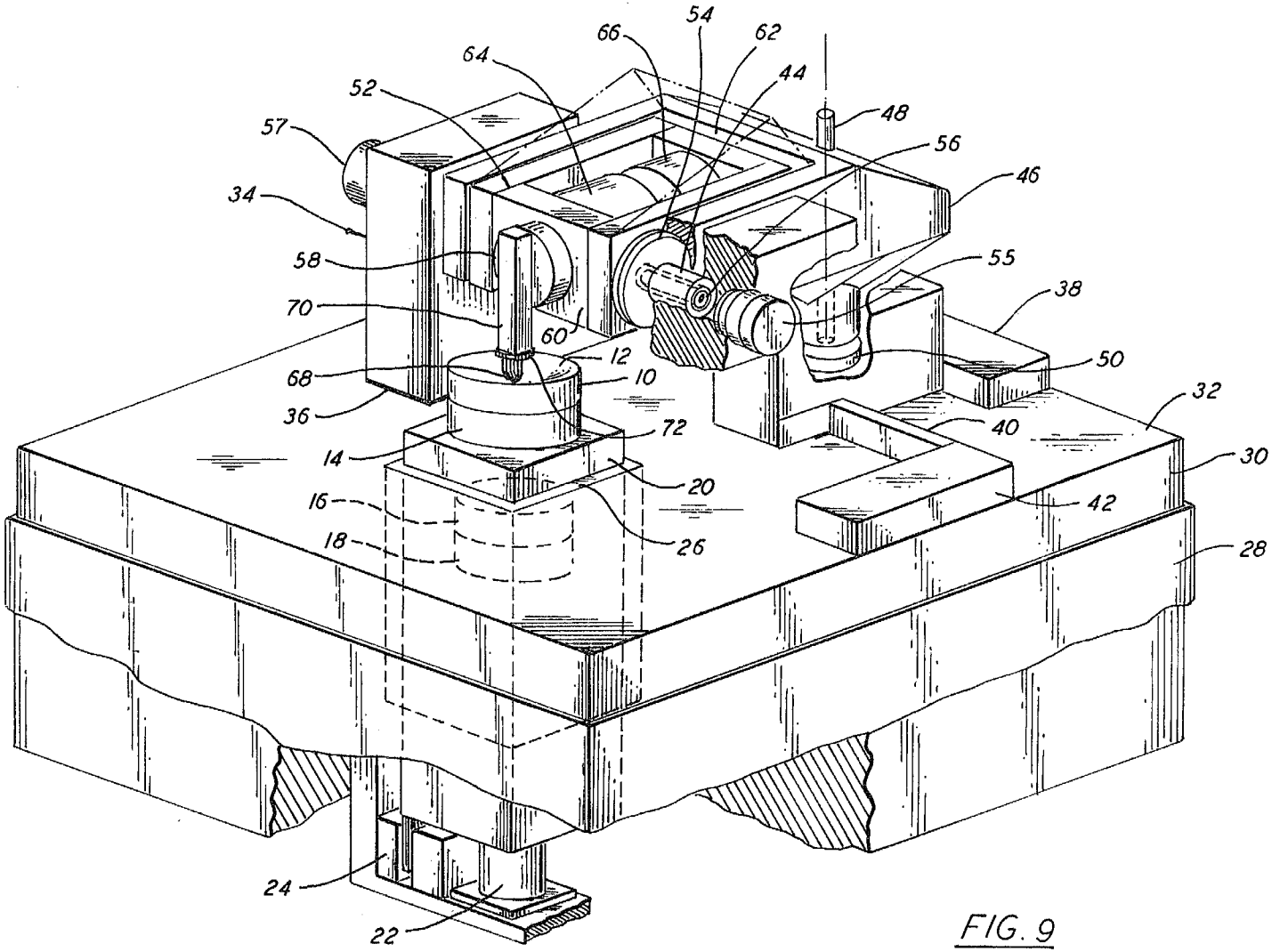
FIG. 9 is an isometric view, partly cut-away, of an aspherical generator according to the present invention.

Referring now to the aspherical generator illustrated in FIG. 9, a shallow cylindrical work piece 10 is coaxially fixed to an upper horizontal surface 12 of a vertical work spindle 14 rotatably drivable about its axis by a work spindle motor 16 which also drives a work spindle transducer 18 to provide an angular velocity signal. These parts are supported by a vertically-extending work spindle column 20 of rectangular cross-section. Column 20 is positionable up-and-down by a vertical position actuator 22, the vertical position of column 20 being sensed by a work spindle column vertical position transducer 24. Actuator 22 may, for example, be a leadscrew or a piston/cylinder device.

The diameter of vertical work spindle 14 is substantially reduced at the top of column 20 and an air bearing is formed thereat between the adjacent horizontal surface of work spindle 14 and column 20. Thus, the enlarged diameter portion of work spindle 14 spins on the top of column 16 like a potter's wheel.

Column 20 is itself associated with air pads 26 facilitating its vertical movements relative to a base support structure 28 which supports a granite base 30 of the aspherical generator.

The upper horizontal surface 32 of base 30 supports a gantry main frame 34 which, throughout operation of the aspherical generator, is locked by any suitable means to surface 32. Frame 34, however, is first slidably positioned by hand over surface 32 on air pads 36 to a set-up position in abutment with a cross slide initial reference block 38 fixed to the rear of base surface 32 and, by way of an intermediate slide position indicator 40 (set of "Jo" blocks), with a slide initial reference block 42 fixed to the right-hand side of base surface 32.

Main frame 34 is provided at each side with a trunnion air bearing 44 to support a dynamic tilt frame 46 for tilting movement about a trunnion axis defined by the respective air bearings 44. Such tilting movement is effected by a dynamic tilt actuator 48 extending vertically through the rear portion of tilt frame 46 and cooperating with a dynamic tilt frame air pad 50 at base surface 32. Actuator 48 may, for example, be of the peizoelectric type.

Supported within dynamic tilt frame 46 for limited angular adjustment about the trunnion axis is a tool feed carriage 52. The angular position of carriage 52 relative to tilt frame 46 is adjustable over 30 degrees in fixed increments for initial set-up purposes by a tool feed carriage angular index device 54 which may comprise, for example, a crown gear separable from an epoxy image.

The position of carriage 52 relative to tilt frame 46 in the direction of the trunnion axis is initially given a bias adjustment by a trunnion axial vernier drive 55 which may, for example, be a micrometer leadscrew, and thereafter during operation of the machine is dynamically adjustable within a small range by a trunnion axis actuator 56 which may, for example, be a piezoelectric device. A signal indicative of the angular position of carriage 52 is provided by a transducer 57 mounted on main frame 34.

Tool feed carriage 52 supports a tool spindle 58 for rotation about a tool spindle axis normal to the front surface 60 and rear surface 62 of carriage 52. The diameter of tool spindle 58 is substantially reduced at front surface 60 of carriage 52 and an air bearing is formed thereat between the adjacent surfaces of tool spindle 58 and carriage 52. Carriage 52 also supports along the tool spindle axis a tool feed motor 64 for rotating tool spindle 58 and a tool feed transducer 66 for providing a signal representative of the angular distance through which tool spindle 58 is rotated.

A diamond tool tip 68 for single-point machining of work piece 10 is held by the free end of a tool holder 70, the other end of which is diametrically fixed to tool spindle 58. Adjustment of the tool radius is provided for by a tool radius adjustment ring 72.

The basic operation of the aspherical generator depicted in FIG. 9 involves the following:

(a) Work piece 10 is mounted on work spindle 14 which is then brought up to speed $\omega$ by energizing work spindle motor 16.

(b) Tool feed carriage angular index 54 is set at some angle which causes the axis of tool spindle 58 to come close to intersecting the vertical axis of work spindle 14 in the vicinity of the center of a sphere which best fits the surface to be generated.

(c) When the plane determined by the inclined tool spindle axis and tool tip 68 is vertical, a machine center is defined directly above tool tip 68 in the direction of the vertical axis of work spindle 14 and on the inclined tool spindle axis in the vertical plane.

(d) When the inclined spindle axis is rotated by tool feed motor 64, tool tip 68 follows a circular arc.

(e) The machine center may be moved at will by changing the angle of inclination of tool spindle 58 by energizing dynamic tilt actuator 48, or by moving tool spindle 58 laterally in the x-direction by energizing trunnion axis dynamic actuator 56 (which movement may be regarded as cross-axis displacement). Any change in the position of the machine center changes the location of the circular arc traced by tool tip 68 as tool feed motor 64 rotates tool spindle 58 about its axis. Therefore, starting with an otherwise well-known spherical generator with the machine center lying on the vertical axis of the work spindle, one may, by propitious choice of the angle of inclination of the tool spindle and the cross-axis displacement thereof, so locate the machine center to generate a circular arc which best fits the desired aspherical surface and intersects it in three points.

(f) On one side of the central point of intersection, the path of tool tip 68 is below the desired surface and, on the other side of the central point of intersection, the path of tool tip 68 is above the desired surface. By judicious choice of the machine center and the spacing of the three points of intersection, an error curve resembling a sine wave as shown in FIG. 6 is produced for the regular conical sections. For practical cases, this error function has an amplitude of a few hundred millionths of an inch. Tool tip 68 may be brought back to the desired surface by adjusting the machine center, as follows:

(1) By making slight changes in the inclination angle of tool spindle 58 as a function of the angular distance through which tool spindle 58 is rotated about its axis by tool feed motor 64.

(2) By making minor adjustments in the cross-axis offset $\delta x$ as a function of the angular distance through which tool spindle 58 is rotated about its axis by tool feed motor 64.

(3) By making minor changes in the level of work piece 10 relative to the machine enter by elevating or lowering work spindle 14 in the z-axis direction through vertical position actuator 22.

(4) By feeding tool tip 68 toward or away from work piece 10 in a direction normal to the desired aspherical surface for the distance δr.

(g) In summary, the aspherical generator depicted in FIG. 9 is first set up to best fit the contour of the aspherical surface desired on work piece 10 when a continuous excursion of tool tip 68 is effected by tool feed motor 64. Then, by making continuous minor adjustments of the angle of inclination of tool spindle 58, δx, δz, δr or combinations thereof, the desired contour is traced by tool tip 68 as the angular distance through which tool tip 68 is driven about the axis of tool spindle 58 by tool feed motor 64 changes and as work piece 10 rotates at a given speed about the axis of work spindle 14.

What I claim is:

1. A method of cutting a desired aspherical surface of revolution on a work piece continuously rotatable about a vertical work spindle axis and engageable by a single-point cutting tip radially displaced from a tool spindle axis, said cutting tip being turnable about said tool spindle axis to describe a circular arcuate path in space, said method comprising:

(a) orienting the tool spindle axis relative to the work spindle axis so that the two spindle axes intersect at a given angle to define a machine center directly above said cutting tip when said cutting tip is at the lowest point in its circular arcuate path;

(b) continuously rotating the work piece about said work spindle axis;

(c) engaging said work piece by said cutting tip; and (d) turning said cutting tip about said tool spindle axis while displacing said machine center to follow the locus of the center of curvature of said desired aspherical surface at said cutting tip.

2. A method according to claim 1, wherein said work spindle axis is the z-axis in an x-y-z polar coordinate system, and wherein said tool spindle axis lies in the y-z plane of said system with said cutting tip disposed at the origin thereof when at said lowest point in its circular arcuate path.

3. A method according to claim 2, wherein the bottom of said aspherical surface of revolution is adjusted to be at said origin of said polar coordinate system by adjusting the level of said work piece along said z-axis.

4. A method according to claim 2, wherein the displacing of said machine center to follow said locus includes a displacement in the direction of the x-axis of said x-y-z coordinate system for causing a toroidal surface to be cut on said work piece.

5. A method according to claim 2, wherein the displacing of said machine center to follow said locus includes a displacement(s) in at least one of the x-axis, y-axis and z-axis directions.

6. A method according to claim 2, wherein the displacing of said machine center to follow said locus is effected by turning said tool spindle axis about a trunnion axis normal to said tool spindle axis and parallel to the x-axis in said x-y-z polar coordinate system.

7. A method according to claim 2, wherein said machine center is initially set up to best fit the contour of said desired aspherical surface of revolution when a continuous excursion of said cutting tip is effected by turning said cutting tip about said tool spindle axis, and wherein continuous minor adjustments are thereafter made of the angle of inclination of said tool spindle axis, or of the distance of the machine center from the x-axis or from the z-axis, or of the distance of the cutting tip from the work piece in a direction normal to the desired aspherical surface, or any combination of said minor adjustments, whereby the desired contour is traced by said cutting tip as the angular distance through which the cutting tip is turned about said tool spindle axis changes and as said work piece rotates at a given speed about said work spindle axis.

8. An aspherical generator for cutting a desired aspherical surface of revolution on a work piece, comprising:

(a) an elongated work spindle having a vertical axis about which it is rotatable and an upper end to which a shallow cylindrical work piece may be coaxially fixed;

(b) means for continuously rotating said work spindle about its said vertical axis;

(c) an elongated tool spindle having a longitudinal axis about which it is rotatable and which intersects said vertical axis of said work spindle at a point above said upper end of said work spindle, said point of intersection defining the machine center of said generator, said vertical work spindle axis and said longitudinal tool spindle axis defining a first vertical plane;

(d) a tool feed carriage in which said tool spindle is mounted and which itself is mounted on trunnions having a trunnion axis normal to said first plane;

(e) an elongated tool holder diametrically fixed to an end of said tool spindle extending outside of said tool feed carriage and holding a single-point cutting tip in position to describe a circular arc in a second vertical plane which, when said tool spindle is horizontal, is normal to said first vertical plane;

(f) means for turning said tool spindle about said longitudinal axis thereof to cause said cutting tip to describe said circular arc;

(g) means for tilting said tool feed carriage about said trunnion axis;

(h) means for moving said tool feed carriage in the direction of said trunnion axis; and (i) means for moving said work spindle in the direction of its said vertical axis.

9. An aspherical generator according to claim 8, wherein said tool feed carriage is mounted in a frame supported for movement about said trunnion axis, and wherein said means for tilting said tool feed carriage about said trunnion axis comprises an indexing device coupling said carriage to said frame for providing an initial angle of tilt of said carriage and a dynamic actuator coupling said frame to an underlying base for providing a continuous adjustment of said initial angle of tilt.

10. In a spherical generator for cutting spherical surfaces of revolution on a work piece, including a workhead spindle, tool holder spindle and trunnions having a trunnion axis normal to the plane of intersecting axes of rotation of said workhead and tool holder spindles, said tool holder spindle being tiltable about said trunnion axis, the improvement wherein first means are provided for continuously offsetting the axis of rotation of the tool holder spindle along the trunnion axis, in combination with second means provided for axially displacing the workhead spindle and third means provided for continuously tilting said tool holder spindle about said trunnion axis.

* * * * *